United States Patent [19]

Crane

[11] 4,266,714

[45] May 12, 1981

[54] BOXES WITH COLUMN-FORMING INSERTS

[75] Inventor: Walton B. Crane, Sherman Oaks, Calif.

[73] Assignee: Industrial Designs & Services, Encino, Calif.

[21] Appl. No.: 165,135

[22] Filed: Jul. 1, 1980

Related U.S. Application Data

[63] Continuation of Ser. No. 6,666, Jan. 26, 1979, abandoned.

[51] Int. Cl.[3] ..... B65D 5/22; B65D 25/22

[52] U.S. Cl. ..... 229/34 HW; 229/DIG. 11; 229/52 AW; 206/821

[58] Field of Search ..... 229/34 R, 34 HW, DIG. 11, 229/52 AW; 206/821

[56] References Cited

U.S. PATENT DOCUMENTS

| | | | |
|---|---|---|---|
| 2,868,430 | 1/1959 | Hamilton | 229/34 R |
| 2,896,835 | 7/1959 | Burkhardt et al. | 229/DIG. 11 |
| 2,914,235 | 11/1959 | Jones | 229/34 R |
| 2,987,198 | 6/1961 | Crane | 206/821 X |
| 3,118,563 | 1/1964 | Sachdolski | 229/35 X |
| 3,211,326 | 10/1965 | Davis | 206/821 |
| 4,039,119 | 8/1977 | Crane | 229/DIG. 11 |
| 4,039,121 | 8/1977 | Crane | 229/DIG. 11 |

*Primary Examiner*—Davis T. Moorhead

*Attorney, Agent, or Firm*—Fulwider, Patton, Rieber, Lee & Utecht

[57] ABSTRACT

Boxes for produce and the like formed by corrugated paperboard containers having end walls defining vertical slots that are aligned when the containers are stacked. Column-forming members are inserted in the slots and interlocked vertically. The containers are supported primarily by the inserts so that the combined weight of containers above is not borne solely by the end walls.

30 Claims, 10 Drawing Figures

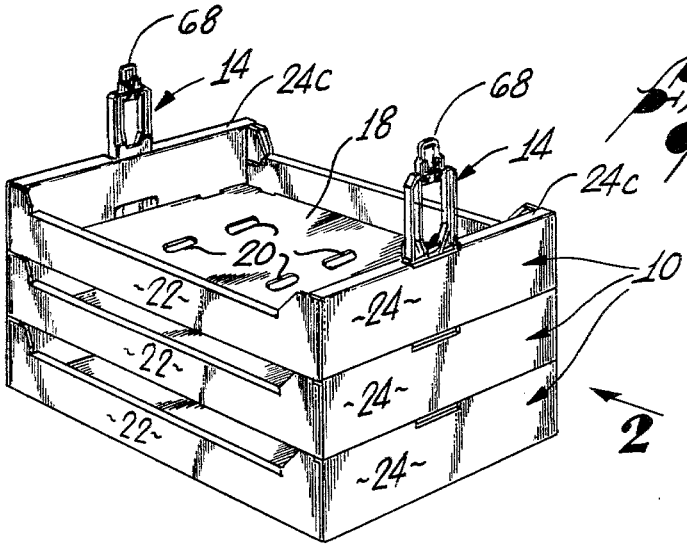
Fig.1
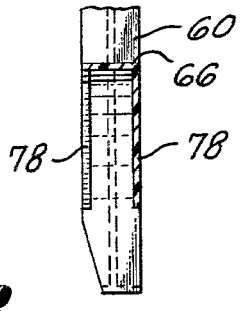
Fig.4
Fig.2
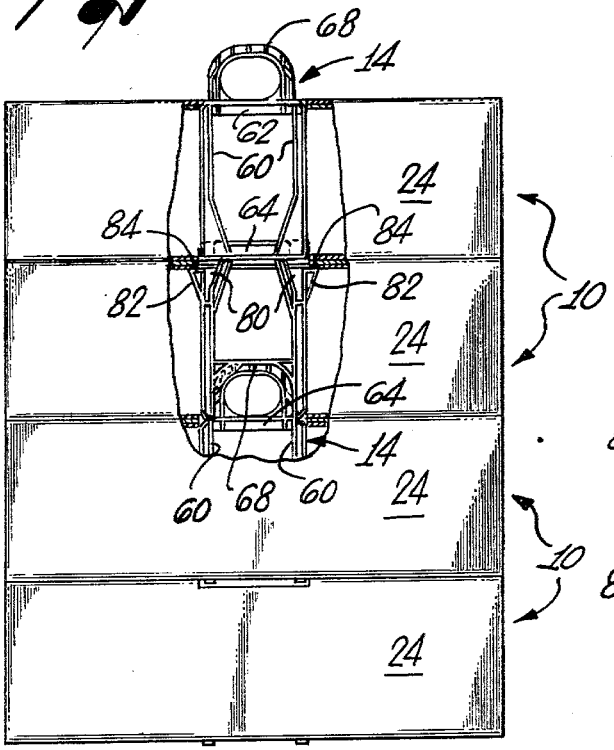
Fig.3
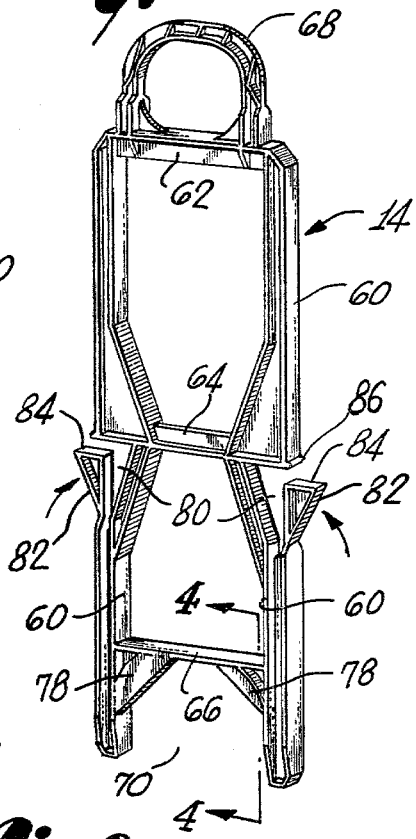
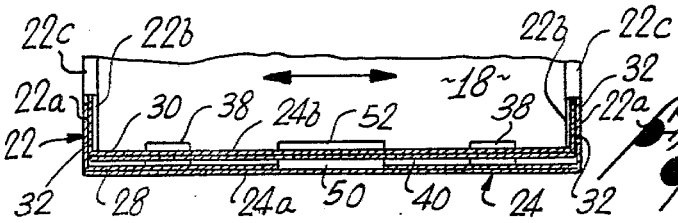
Fig.6

BOXES WITH COLUMN-FORMING INSERTS

This is a continuation, of application Ser. No. 6,666, filed Jan. 26, 1979, now abandoned.

BACKGROUND OF THE DISCLOSURE

The present invention relates to boxes for produce and the like and, more particularly, to such boxes that are capable of being stacked to considerable height without collapsing or becoming unstable.

When agricultural produce such as grapes and strawberries are picked, it is packed in the field in relatively flat, open-topped trays or boxes. These boxes are stacked on pallets for shipping and storage, a stack often being sixteen, eighteen or more boxes high.

Since the boxes are generally used only once and are consumed in large numbers, running into many millions each growing season, their cost must be kept to a minimum, yet they must be strong enough to protect the produce against degradation. They should be lightweight and have a maximum capacity in comparison to their external dimensions. Generally, they are made from folded paperboard blanks and commonly include wire inserts in their end walls by which they are interlocked when stacked vertically.

Great attention has been given to the details of construction to provide the strongest boxes at the lowest cost. Many small variations have been proposed in the manner in which blanks are cut and scored in an effort to advance the art. Nevertheless, a persistent problem and limiting factor in the construction of these boxes is the strength of the end walls. When the boxes are stacked, the end walls of the lower boxes must bear the weight of the boxes above. If the end walls are partially crushed, the stack may begin to lean and become unstable. It is the required strength of the end walls that usually determines the weight of the paperboard to be used.

The need for end walls that can withstand high vertical compressive forces has also dictated that the corrugated blanks must be arranged so that the flutes of the end walls extend vertically. Unfortunately, this construction necessitates that the flutes in the bottom of the box run the long way between the end walls, thereby providing a floor that has considerably less strength and resistance to sag than a box with the floor flutes running parallel to the end walls.

A primary objective of the present invention is to provide a box of improved strength and rigidity that can be stacked higher with greater stability. A further objective is to provide such a box in which the end walls need not support the combined weight of all the boxes above.

SUMMARY OF THE INVENTION

The present invention accomplishes the above objectives and resides in a box in which interlocking column-forming members are secured to the end walls to form continuous vertical columns by which paperboard containers are supported.

Preferably, the end walls of the containers each include an inner panel and an outer panel with a slot formed between the panels. When the containers are stacked, the slots are aligned vertically to receive the column-forming members as inserts.

Each insert, preferably made of plastic, may have a recess on its bottom end that receives a protrusion on the top of the insert below. The protrusions also function as handles. It is best to use inserts that extend through more than one container and preferably each set of inserts connects two boxes.

An advantageous provision for supporting the boxes from the inserts employs a pair of support tabs integrally formed with each insert. Each tab is resiliently joined to the remainder of the insert and is movable between an extended position in which it engages the end wall and a withdrawn position that facilitates its insertion in the slot.

Each container is formed from a single, folded, corrugated, paperboard blank that forms the floor, sidewalls and end walls. Since the inserts carry most of the load that would otherwise be borne by the end walls, the direction of the flutes can be arranged differently than in conventional boxes, extending across the floor between the sidewalls. This construction provides a more rigid container with a floor less subject to sagging.

Other features and advantages of the present invention will become apparent from the following detailed description, taken in conjunction with the accompanying drawings, which illustrate, by way of example, the principals of the invention.

BRIEF DESCRIPTION OF THE DRAWINGS

FIG. 1 is a perspective view of a stack of three boxes in accordance with the present invention, the uppermost box having inserts the top halves of which are exposed and ready to receive a fourth box;

FIG. 2 is an enlarged end view of the stack of FIG. 1 after a fourth box has been added, the end walls of some boxes being partially broken-away to expose the inserts;

FIG. 3 is a further enlarged perspective view of an insert; FIG. 4 is a still further enlarged fragmentary cross-sectional view of an insert taken along the line 4—4 of FIG. 3;

FIG. 6 is a fragmentary cross-sectional view of one end of the box without inserts taken along the line 6—6 of FIG. 5;

DESCRIPTION OF THE PREFERRED EMBODIMENT

A stack of boxes 10 for produce and the like, shown in FIG. 1 of the accompanying drawings, includes many features of the present invention. In general, the boxes 10 are formed by paperboard containers 12 and plastic inserts 14.

Figure 5:
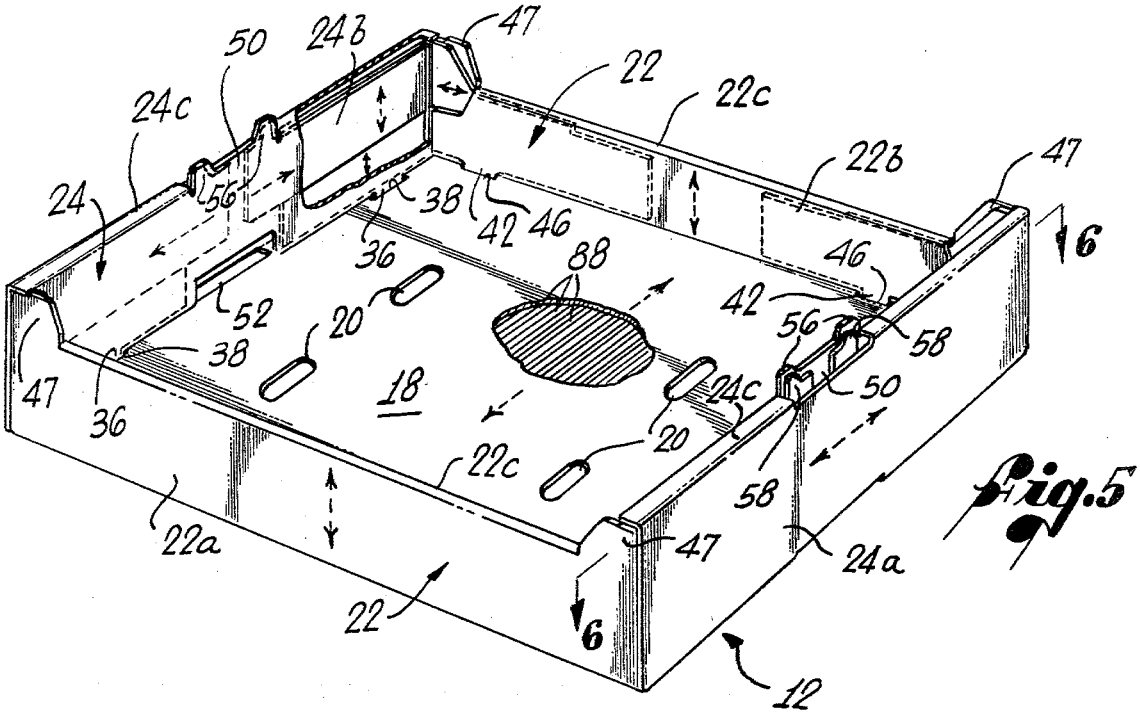
FIG. 5 is a perspective view of one of the boxes without inserts, a portion of the top layer of the floor being broken away to expose the flutes, and a portion of one end wall being broken away to expose its internal structure.
Figure 7:
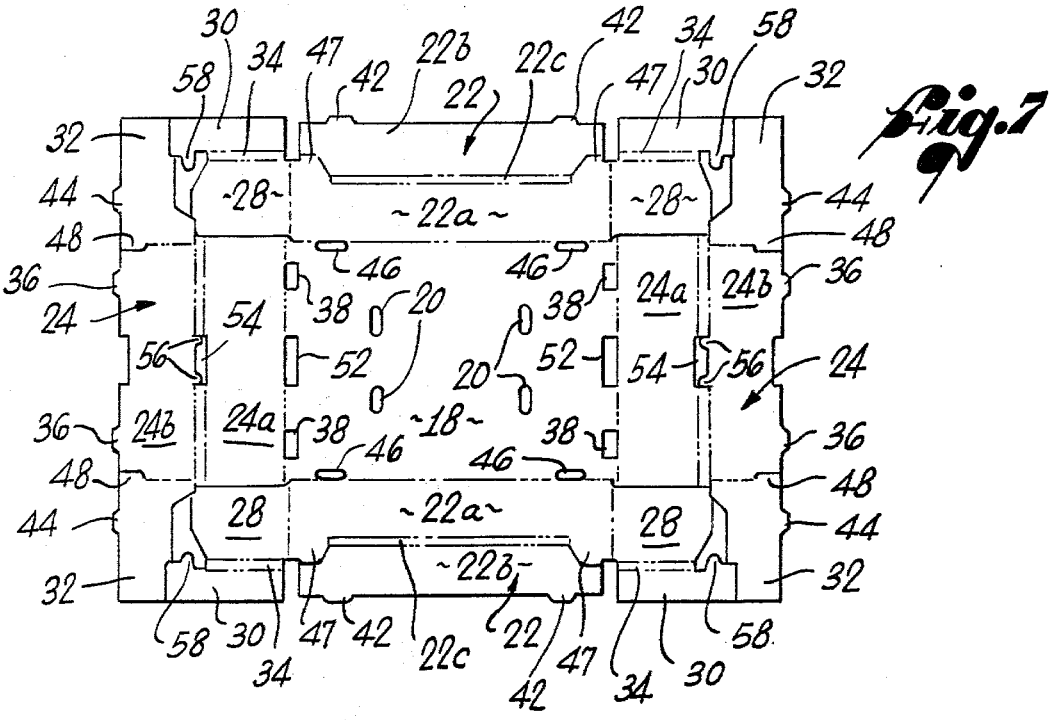
FIG. 7 is a plan view of an unfolded blank from which the box of FIG. 5 is constructed.

An individual container 12, shown separately in FIG. 5, is formed by folding a single, corrugated blank 16, shown in FIG. 7. The blank 16 is divided by cut lines and score lines to define a plurality of panels. It includes a relatively large, rectangular floor panel 18 provided with vent holes 20 in the conventional manner. Attached to the longer edges of the floor panel 18 are two sidewalls 22 while two end walls 24 are attached to its shorter edges. Each wall 22, 24 includes an outer panel **22*a*, 24*a* joined directly to the floor panel 18 and an inner panel 22*b*, 24*b* joined to the corresponding outer panel by a long narrow top strip 22c, 24c. At the corners of the blank 16 are supplemental strengthening panels 28, 30 and 32** that complete its generally rectangular shape.

Figure 8:
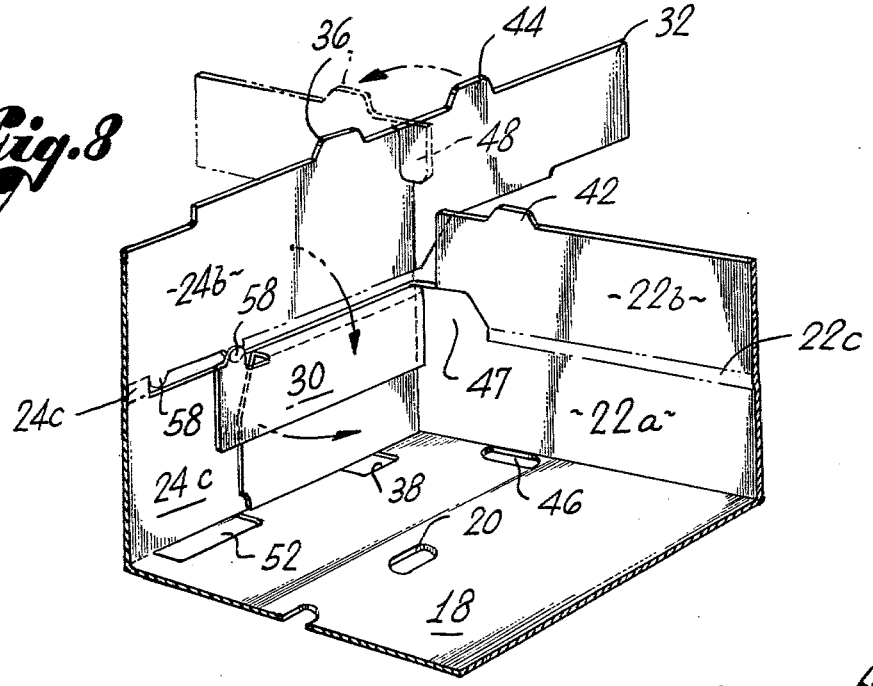
FIGS. 8, 9 and 10 are fragmentary perspective views of a corner of the box in successive stages of assembly.

To assemble the container 12, the outer panels 22a and 24a of the sidewalls 22 and end walls 24 are bent upwardly into a vertical position. The first strengthening panel 28, joined to each of the vertical edges of the outer sidewall panels 22a, is folded at a 90 degree angle to the outer sidewall panel so that it extends along the inside of the outer panel 24a of the adjacent end wall 24 (FIG. 8). The second strengthening panel 30, connected by a narrow top strip 34 to the top edge of the corresponding first strengthening panel 28, is then folded downwardly.

Figure 9:
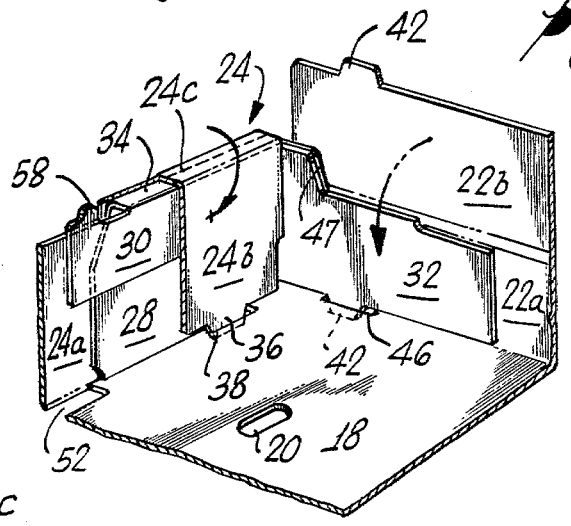

To complete the assembly of the end wall 24, the inner end wall panel 24b is folded down over the first and second strengthening panels 28 and 30 and a pair of holding tabs 36 on its bottom edge are inserted in a set of positioning holes 38 in the floor panel 18 (as shown in FIG. 9). The outer end wall panel 24a thus overlies the first strengthening panels 28 while the inner end wall panel 24overlaps the second strengthening panel 30. A small narrow space 40 remains between the opposing surfaces of the first and second strengthening panels 28 and 30, as best shown in FIG. 6.

Figure 10:
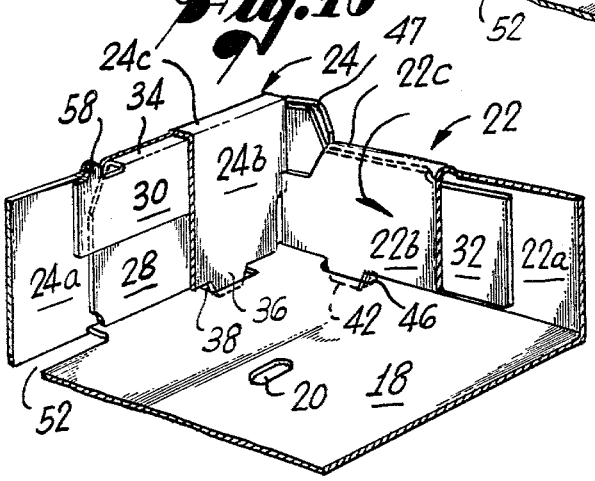

The third strengthening panel 32 extends from the vertical edges of the inner end wall panels 24b. When the inner end wall panels 24b are bent downwardly, the corresponding third strengthening panels 32 are folded at 90 degree angles so that they overlie the inwardly facing surfaces of the outer sidewall panels 22b (FIG. 9). As the last step in assembling the container 12, the inner sidewall panels 22a are folded down over the third strengthening panels 32 (FIG. 10). Holding tabs 42 and 44 on the lower edges of the inner sidewall panels 22a and the third strengthening panels 32 share a common set of positioning holes 46 in the floor panel 18. Although the sidewalls 22 are generally of lesser height than the end walls 22, the inner sidewall panels 22b are notched to accommodate end portions 47 on the outer sidewall panels 22a that rise to the full height of the end walls 24.

A fine point of the construction of the container 12 is found in a set of small reinforcing tabs 48 on the vertical edges of the third strengthening panels 32 that extend past the vertical edges of the inner end wall panels 24b and the first and second strengthening panels 28 and 30 to abut the inside surfaces of the outer end wall panels 24a. These reinforcing tabs 48 rigidify the corners of the container 12 by preventing the end walls 24 from bending inwardly.

A vertical slot 50 is formed in each end wall 24 between its inner and outer panels 24a and 24b (as best shown in FIGS. 5 and 6), these slots being vertically aligned when the containers 12 are stacked. To form the slots 50, openings 52 are provided in the floor panel 18 beneath the center of each end wall 24 and a corresponding opening 54 is cut in the top strip 24c of each end wall. The vertical edges of the slots 50 are coincident with the ends of the first strengthening tabs 28.

Adjacent each end of the slot 50 at the top thereof, small upstanding protrusions 56 and 58 are formed on the top edges of the inner end wall panels 24b and the second strengthening panel 30. When the containers 12 are stacked, these protrusions 56 and 58 fit into the slot 50 of the container above to inhibit relative lateral shifting between the containers, even before the plastic inserts 14 have be installed.

The inserts 14 for the slots 50, best shown in FIG. 3, are each integrally molded as an open framework. Each includes two vertical side pieces 60 joined by three horizontal cross-pieces 62, 64 and 66 at the top, at the middle and near the bottom. The width of the insert 14, measured from the edge of one side piece 60 to the other is equal to the length of the slot 50 for a tight fit. Its thickness fills the slot 50 between the second strengthening panel 30 and the inner end wall panel 24b to provide a more rigid structure when compared to a more conventional end wall that receives a loose fitting wire as an interlocking device.

An inverted U-shaped member 68 forms a projection with an open center that extends upwardly from the top cross-piece 62 of each insert 14. When the inserts 14 are interlocked, this projection 68 is snugly received by a recess 70 in the insert 14 above. The recess is formed below the bottom cross-piece 66 and between the lower ends of the side pieces 60 (as illustrated in FIG. 2). Once the projection 68 is seated within the recess 70, it is held against rotation about a vertical axis by a pair of corner-spanning restrainers 78 at the intersections of the side pieces 60 with the bottom cross-piece 66 (FIGS. 3 and 4).

Immediately below the middle cross-piece 64, the side pieces 60 are indented to form outwardly facing V-shaped notches 80. At the bottom of each notch 80, the side piece 60 is joined to a V-shaped container support tab 82 that normally extends outwardly from the vertical edge of the side piece and provides an upwardly facing horizontal abutment surface 84. With moderate pressure, the support tabs 82 can be bent inwardly into the notches 80 so they do not extend beyond the edges of the side pieces 60.

A pair of inserts 14 are pressed downwardly into the slots 50 of a container 12, positioning of the inserts being aided by a taper of the lower ends of the side pieces 60. Each insert 14, not including the projection 68 at the top, is approximately twice the height of a single container 12. The tabs 82, being outwardly tapered from the bottom, bend inwardly to pass through the opening 54 at the top of the slot 50 and then spring out again so that the abutment surfaces 84 can engage the underside of the end wall top strips 24c to prevent the insert 14 from being withdrawn. When the insert 14 is fully in place, a small horizontal bead 86 on each side piece 60, opposite the middle cross-piece 64 and just above the notch 80, comes to rest on the top strip 24c of the end wall 24 to arrest the downward motion.

After another insert 14 has been installed in the opposite end wall 24, a second container 12 may be placed over the exposed upper halves of the insert 14 to rest on the end walls of the container below, forming a single pair of interlocked boxes 10. These two boxes 10 may then be carried as a unit, with the projections 68 on the tops of the inserts 14 serving as handles.

It should be noted that when the boxes 10 are stacked, every other box is supported by the tabs 82 of one of the inserts 14 and not by the box below it. In essence, the inserts 14 form vertical columns from which the containers 12 are hung in pairs. The end walls 24 of the boxes 10 at the bottom of the stack are not crushed by the weight of the boxes above.

Because the end walls 24 need not carry the weight above, it is possible to use blanks 16 in which the flutes 88 run along the end walls and across the floor 18 (FIG.

5) so that each box 10 has improved floor strength to support its own contents. It should also be noted that the first strengthening panels 28, being extensions of the outer sidewall panels 22*a*, have their flutes oriented vertically for greater reinforcement of the end walls 24, especially at the ends, to stabilize the stack.

Preferably, each pair of containers 12 is slightly taller than the inserts 14 (excluding the projections 68). Initially, when a stack is formed, a small amount of compression takes place, reducing the end wall height of the containers 12 and permitting the end walls 24 to more effectively resist tipping or wobbling.

In addition to the advantages noted above, the boxes 10 of the invention are inexpensive to fabricate. They can be assembled easily and quickly by machine or by unskilled labor.

While a particular form of the invention has been illustrated and described, it will also be apparent that various modifications can be made without departing from the spirit and scope of the invention.

I claim:

1. A box for produce and the like comprising:

a folded paperboard container having a floor, sidewalls and end walls; and column-forming means secured to each of said end walls and extending at least the full height of said end walls of said container and including interlocking means at its upper and lower ends for lockingly engaging similar column-forming means of other boxes when a plurality of the boxes are arranged in a vertical stack for defining continuous columns extending completely through all the boxes in the stack, said column-forming means including means for vertically supporting said container.

2. The box of claim 1 wherein said container is formed from a single blank.

3. The box of claim 1 wherein said paperboard is corrugated with flutes extending across said floor between said sidewalls.

4. The box of claim 1 wherein said column-forming means are plastic members.

5. The box of claim 1 wherein said column-forming means are at least twice the height of said end walls.

6. The box of claim 1 wherein each of said end walls includes an inner panel and an outer panel and defines a vertical slot extending between said panels in which one of said column-forming means is received.

7. The box of claim 6 wherein said column-forming means includes a plurality of support tabs for engaging said end walls to support said container.

8. A vertical stack of boxes for produce and the like comprising:

a plurality of relatively flat, open-topped containers each formed from a single, folded, corrugated, paperboard blank and including a floor, sidewalls and end walls, said end walls each having an inner panel and an outer panel and defining a vertical slot extending therethrough between said inner and outer panels, the slots of successive containers being aligned; and a plurality of plastic column-forming inserts disposed within said slots and each extending at least the full height of the associated container end wall and including at its upper and lower ends interlocking means for locking engagement with column-forming inserts above and below in the stack to define continuous columns extending the full height of the stack, each of said inserts having at least one container support means for engaging the end wall of one of said containers to support vertically said one of said containers.

9. The boxes of claim 8 wherein each of said inserts extends vertically through at least two of said containers.

10. The box of claim 8, wherein each of said inserts includes a protrusion at the top end thereof and a recess at the bottom end thereof to facilitate said interlocking.

11. The boxes of claim 10 wherein each of said protrusions is open at the center thereof to form a handle.

12. The boxes of claim 8 wherein each of said floors has flutes extending between said sidewalls.

13. The boxes of claim 8 wherein each of said container support means comprises a pair of tabs integrally formed with the remainder of said insert and resiliently joined thereto to permit movement of said tabs between extended positions in which they are engageable with corresponding ones of said end walls and retracted positions that facilitate insertion in corresponding ones of said slots.

14. The boxes of claim 8 wherein each of said inserts includes means for limiting downward movement thereof within said slots.

15. The boxes of claim 8 further comprising a plurality of strengthening panels extending from said outer sidewall panels between said inner and outer end wall panels, said floor having flutes extending thereacross between said sidewalls and said strengthening panels having flutes extending vertically.

16. The boxes of claim 15 wherein at least some of said strengthening panels partially define said slots.

17. A vertical stack of boxes for produce and the like comprising:

a plurality of relatively flat, open-topped containers each formed from a single, folded, corrugated, paperboard blank and including a floor, sidewalls and end walls, said floor having flutes extending thereacross between said sidewalls, and said end walls having spaced-apart parallel inner and outer panels and defining a vertical slot extending therethrough, the slots of successive containers being aligned; and a plurality of vertically interlocked, plastic, column-forming inserts disposed within said slots, each of said inserts being at least twice the height of one of said containers, having a protrusion on the top end thereof with an open center portion that forms a handle and a recess at the bottom end thereof shaped and dimensioned to receive said protrusion of another of said inserts, having a pair of tabs integrally formed with the remainder of said insert and resiliently joined thereto to permit movement of said tabs between extended positions in which they are engageable with corresponding ones of said end walls and retracted positions that facilitates insertion in corresponding ones of said slots, and having means for limiting downward movement thereof relative to said slots.

18. The boxes of claim 17 further comprising a plurality of strengthening panels extending from said outer sidewall panels between said inner and outer end wall panels, said floor having flutes extending thereacross between said sidewalls and said strengthening panels having flutes extending vertically.

19. The box of claim 1 wherein each of said end walls includes an inner panel and an outer panel and defines a vertical slot extending between said panels in which one of said column-forming means is received, each of said column-forming means including at least one resilient tab movable between a retracted position to facilitate insertion of said column-forming means in one of said slots and an extended position for engaging said end wall for vertically supporting said container.

20. The box of claim 19 wherein each of said column-forming means further includes means for engaging said end wall for limiting downward movement of said column-forming means when said tab is in supporting engagement with said end wall.

21. The boxes of claim 9 wherein said container support means engages the end wall of the lower container of said two containers through which said insert extends for vertically supporting said lower container together with the upper container.

22. A vertical stack of boxes for produce and the like, comprising:

a plurality of relatively flat, open-topped containers each formed from a single, folded, corrugated, paperboard blank and including a floor, sidewalls and end walls, said end walls each having an inner panel and an outer panel and defining a vertical slot extending therethrough between said inner and outer panels, the slots of successive containers being aligned; and a plurality of plastic column-forming inserts each extending at least twice the full height of the associated container end wall and received vertically within the aligned slots of a pair of said containers in the stack, each of said inserts including container support means for engaging the end wall of the lowermost associated container for vertically supporting said pair of associated containers, each of said inserts further including at its upper and lower ends interlocking means for locking engagement with column-forming inserts above and below in the stack to define continuous vertical columns extending the full height of the stack.

23. The boxes of claim 22 wherein said interlocking means comprises for each of said inserts a protrusion at the top end thereof and a recess at the bottom end thereof to facilitate said interlocking.

24. The boxes of claim 23 wherein each of said protrusions is open at the center thereof to form a handle.

25. The boxes of claim 22 wherein each of said inserts includes means for limiting downward movement thereof within said slots.

26. For use in a vertical stack of boxes each formed by a floor, sidewalls, and end walls with said end walls each having an inner panel and an outer panel cooperating to define a vertical slot extending therethrough with the slots of successive boxes in the stack being aligned vertically, a column-forming insert for vertically supporting the boxes in the stack, comprising:

a vertically extending insert member sized for relatively snug reception in one of the slots formed in the end walls of the boxes and having a height to extend at least the full height of the associated end wall, said insert member including support means for engaging the end wall for vertically supporting the box and interlocking means at the upper end lower ends thereof for cooperation with similar insert members received in the slots of boxes above and below in the stack for defining continuous columns extending completely through all of the boxes in the stack.

27. The insert of claim 26 wherein said support means comprises a plurality of outwardly projecting resilient tabs.

28. The insert of claim 27 wherein said insert member further includes means for limiting downward movement thereof within said slot.

29. The insert of claim 26 wherein said interlocking means comprises for each of said insert members a protrusion at the top end thereof and a recess at the bottom end thereof to facilitate said interlocking.

30. The insert of claim 29 wherein each of said protrusions is open at the center thereof to form a handle.

* * * * *